US005575899A

United States Patent [19]

Nakakoji et al.

[11] Patent Number: 5,575,899

[45] Date of Patent: Nov. 19, 1996

[54] ELECTROLYTIC ZINC-NICKEL ALLOY PLATING SOLUTION AND A METHOD OF THE PLATING USING THE SAME

[75] Inventors: Hisatada Nakakoji; Kazuhiro Hasegawa; Kazuo Mochizuki; Tokumitsu Kimura; Kazuhiro Ohotsuka; Hidenori Shirai, all of Chiba, Japan

[73] Assignee: Kawasaki Steel Corporation, Hyogo, Japan

[21] Appl. No.: 521,072

[22] Filed: Aug. 29, 1995

[30] Foreign Application Priority Data

Aug. 31, 1994 [JP] Japan ..... 6-206852
Jun. 1, 1995 [JP] Japan ..... 7-135319

[51] Int. Cl.[6] ..... C25D 3/56

[52] U.S. Cl. ..... 205/246; 205/255; 205/259; 205/260

[58] Field of Search ..... 205/246, 255, 205/259, 260, 305, 313, 314, 271, 274, 280; 106/1.22, 1.25

[56] References Cited

U.S. PATENT DOCUMENTS 4,285,802 8/1981 Rynne ..... 205/246
4,401,526 8/1983 Martin ..... 205/245
4,543,166 9/1985 Lash ..... 205/246
4,569,731 2/1986 Matsuda et al. ..... 205/246

OTHER PUBLICATIONS

Metal Finishing Abstracts, vol. 23, No. 5, Sep. 1981, 6B, p. 314, Popovich.

*Primary Examiner*—Kathryn Gorgos
*Assistant Examiner*—Edna Wong
*Attorney, Agent, or Firm*—Staas & Halsey

[57] ABSTRACT

The present invention relates to an electrolytic zinc-nickel alloy plating solution, which comprises a plating solution containing zinc chloride, nickel chloride, and potassium chloride; polyethylene glycol having a molecular weight of 400–800 as a nonionic surfactant in an amount of 0.01–1.0 gram/liter; and at least one compound selected from the group consisting of nicotinic acid, urea, thiourea, nicotinamide, thioglycolic acid and sodium thiosulfate as a compound having a lone pair of electrons in an amount of 0.001–1.0 gram/liter. When the plating solution of the present invention is used, needle-shaped stain is not caused on a plated surface and the edge of a plated steel sheet need not be trimmed because a less amount of burning is caused thereto.

14 Claims, No Drawings

ELECTROLYTIC ZINC-NICKEL ALLOY PLATING SOLUTION AND A METHOD OF THE PLATING USING THE SAME

BACKGROUND OF THE INVENTION

1. Field of the Invention

The present invention relates to the manufacture of a zinc-nickel alloy plated steel sheet having excellent corrosion resistance and used for automobiles, home electric appliances, building materials, etc. More specifically, the present invention relates to a zinc-nickel alloy plating solution for restraining defects on a surface caused in zinc-nickel plating and in particular needle-shaped stain on a plated surface and burning at the edge of a steel sheet.

2. Description of the Related Art

It is well-known that a zinc-nickel alloy plated steel sheet has a plated layer made to a single γ phase when a nickel content is 10–16% and the steel sheet exhibits high corrosion resistance. As a method of industrially applying electrolytic zinc-nickel alloy plating to a steel sheet, there are known a method of using a sulfuric acid bath mainly containing zinc sulfate and nickel sulfate, and a method of using a chloride bath mainly containing zinc chloride and nickel chloride. Since it is difficult for nickel to be deposited in a plating layer in the sulfuric acid bath, an atomic percentage of nickel in a plating solution is larger than that of nickel in an alloy plated layer, and thus a lot of expensive nickel sulfate must be used in the plating solution. On the other hand, the chloride bath has an advantage that an atomic percentage of nickel in an alloy plated layer is approximately equal to that of nickel in a plating solution, and thus a plating operation can be easily managed.

When electrolytic zinc-nickel alloy plating is continuously applied to a steel sheet in the chloride bath, a white pattern called "needle-shaped stain" having a width of about 1 mm and a length of about 1–20 mm may be formed on a plated surface due to a fine irregular flow of a plating solution. Although the needle-shaped stain does not have any effect on corrosion resistivity, a commodity value of outside appearance of the plated steel sheet is lowered by it.

When a needle-shaped stain portion is observed, plated crystals become coarse granular crystals. A reason why such coarse granular crystals are made is that plating metal ions are insufficiently supplied due to the disturbance of the flow of the plating solution, and it is supposed that a portion containing the coarse crystals seems white.

On the other hand, when an electrolytic zinc-nickel alloy plating is continuously applied to a steel sheet by a continuous electroplating method using the chloride bath, since a plating solution in the chloride bath has a high electric transmission as compared with that in the sulfuric acid bath, a plating current is liable to concentrate on the edges of the steel sheet. When the current excessively concentrates, the diffusion and replenishment of ions cannot catch up with the concentration of the current causing a shortage of ions. As a result, the zinc-nickel alloy plating has a poor intimate contact property with a coarse grain size and a plated portion seems black. Such a black state of plating is usually called "burning".

Burning is liable to be produced in the electrolytic zinc-nickel alloy plating using the chloride bath due to the concentration of current on the edges of a steel sheet. When the burning occurs, burnt edges must be cut off by trimming because the portion does not have an economic value.

On the other hand, there have been examined methods of obtaining a plated steel sheet having an excellent outside appearance in the zinc-nickel alloy plating using the chloride bath. For example, there are a method of effecting plating at a flow rate of a solution of 20 m/min or higher disclosed in Japanese Patent Unexamined Publication No. 57-164999 (1982), and a method of adding at least one compound selected from the group consisting of aluminum chloride, ammonium aluminum chloride, ammonium chloride, potassium chloride, calcium chloride, barium chloride, sodium chloride, and magnesium chloride disclosed in Japanese Patent Unexamined Publication No. 58-55585 (1983). However, these methods intend to stabilize a plated composition by examining plating conditions and the composition of a precipitated alloy and do not solve the defects on a surface such as needle-shaped stain, burning and the like.

Further, although Japanese Patent Unexamined Publication No. 58-210189 (1983) discloses a method of using an organic brightener such as a β-aminopropionic acid derivative, its copolymer etc., such a so-called brightener only improves the brightness of a plated surface and does not solve defects on a surface such as "needle-shaped stain", "burning" and the like. That is, a so-called brightener intends to obtain a leveling effect for smoothing an irregular state of entire plating and a brightening effect for making a plated surface bright by improving a reflectance ratio on the plated surface and does not restrain a partial unevenness such as "needle-shaped stain" and "burning" of edges, which is intended to be solved by the present invention. Further, there is not yet known a plating solution capable of solving the problem of "needle-shaped stain" and "burning" caused by the zinc-nickel alloy plating using the chloride bath.

Although a so-called brightener sometimes employs a surfactant and an organic compound as its main agent, an action of these components to plating is greatly different depending upon types of plating metals and plating solutions. Therefore, it is important to find types of components, combination thereof and a range of concentration thereof by which a target effect can be obtained in a specific plating solution for obtaining a specific plated metal, and the determination of these components, combination and range of concentration thereof is a novel technical achievement.

SUMMARY OF THE INVENTION

An object of the present invention is to provide a chloride plating solution for electrolytic zinc-nickel alloy plating capable of restraining the occurrence of needle-shaped stain and/or burning.

Another object of the present invention is to provide a method of manufacturing an electrolytic zinc-nickel alloy plated steel sheet using the chloride plating solution so as to restrain defects on a surface such as needle-shaped stain, burning and the like.

DESCRIPTION OF THE PREFERRED EMBODIMENTS

The present invention provides an electrolytic zinc-nickel alloy plating solution, which comprises a plating solution mainly composed of zinc chloride, nickel chloride and potassium chloride, polyethylene glycol having a molecular weight of 400–800 as a nonionic surfactant in an amount of 0.01–1.0 gram/liter, and at least one compound selected from the group consisting of nicotinic acid, urea, thiourea, nicotinamide, thioglycolic acid and sodium thiosulfate as a compound having a lone pair of electrons in an amount of 0.001–1.0 gram/liter so that the occurrence of needle-shaped stain and burning is restrained.

The above plating solution is prepared as an electrolytic zinc-nickel alloy plating solution which contains polyethylene glycol having a molecular weight of 400–800 in an amount of 0.1–1.0 gram/liter as the nonionic surfactant and at least one compound selected from the group consisting of nicotinic acid, urea, thiourea, nicotinamide, thioglycolic acid and sodium thiosulfate in an amount of 0.01–1.0 gram/liter as the compound having a lone pair of electrons. Thus, the plating solution is very preferable to restrain needle-shaped stain.

The above plating solution is prepared as an electrolytic zinc-nickel alloy plating solution which contains polyethylene glycol having a molecular weight of 400–800 in an amount of 0.01–0.2 gram/liter as the nonionic surfactant and at least one compound selected from the group consisting of thiourea, thioglycolic acid and sodium thiosulfate in an amount of 0.001–0.02 gram/liter as the compound having a lone pair of electrons, thus the plating solution is very preferable to restrain burning.

Any of the above plating solutions more preferably contains an organic compound bearing a carbon-carbon double bond, and in this case the organic compound is preferably at least one compound selected from the group consisting of fumaric acid, sodium fumarate, disodium fumarate, maleic acid, sodium maleate, disodium maleate and sodium allylsulfonate (that is, sodium 1-propen-3-sulfonate) in an amount of 0.01–0.1 gram/liter.

Further, according to the present invention, there is provided a method of manufacturing a zinc-nickel alloy plated steel sheet, which comprises the step of plating a steel sheet with an electrolytic zinc-nickel alloy using any of the above plating solutions at a plating temperature of from 40° to 70° C. and a current density of 50–150 A/dm$^2$.

The present invention will be described below in more detail.

The chloride plating solution of the present invention contains zinc chloride, nickel chloride and potassium chloride as its basic component. Zinc chloride and nickel chloride supply $Zn^{2+}$ ions and $Ni^{2+}$ ions necessary to zinc-nickel alloy plating. It is preferable that a total amount of zinc chloride and nickel chloride in the plating solution is 1 to 4 moles/liter, and that a molar ratio of $Zn^{2+}$ ions and $Ni^{2+}$ ions is preferably Ni/(Ni+Zn)=0.13–0.16.

When a total amount of zinc chloride and nickel chloride is less than 1 mole/liter, satisfactory plating cannot be obtained due to an insufficient amount of ions. Whereas when a total amount exceeds 4 moles/liter, there exists an amount of ions more than necessary, and thus such an amount is not only uneconomical but also inconvenient because salt exceeding its limit of solubility is precipitated.

A molar ratio of $Zn^{2+}$ ions and $Ni^{2+}$ ions Ni/(Ni+Zn), when it is less than 0.13, is not preferable because alloy plating does not become a single $\gamma$ phase but a $\eta$ phase having bad corrosion resistance is mixed, whereas a molar ratio exceeding 0.16 is not preferable because a weight percent of nickel in a plated layer becomes excessively high and an intimate contact property of plating is deteriorated.

Potassium chloride, which provides a plating solution with electric conductivity, is preferably contained in an amount of 3–5 moles/liter. An amount of potassium chloride, when it is less than 3 moles/liter, is not economical because the plating solution has low electric conductivity and a large amount of electric power is required for electro-plating, whereas an amount exceeding 5 moles/liter is not preferable because the precipitation of potassium chloride occurs.

A nonionic surfactant is added with a plating solution in the present invention to restrain the aforesaid needle-shaped stain and/or burning. The nonionic surfactant improves the wettability of a plating surface and restrains the adhesion of foreign substances and bubbles by which the disturbance of the flow of the plating solution is caused. Polyethylene glycol (PEG), having a molecular weight of 400–800, is suitable as the nonionic surfactant and an amount of addition thereof is 0.01–1.0 gram/liter and more preferably 0.01–0.8 gram/liter. When a molecular weight of polyethylene glycol is less than 400, wettability is not sufficiently improved, whereas when a molecular weight thereof exceeds 800, a nickel content in a plated layer is greatly lowered, and thus such a molecular weight is not preferable. When an amount of addition of the polyethylene glycol is less than 0.01 gram/liter, wettability is not sufficiently improved, whereas when the polyethylene glycol is added in an amount exceeding 1.0 gram/liter, a nickel content in a plated layer is greatly lowered, and thus such an amount of addition of polyethylene glycol is not preferable.

A compound having a lone pair of electrons is also added with a plating solution at the time. The compound restrains the growth of plated crystals at the portions where the flow of the plating solution is disturbed because the lone pair of electrons in the compound are adsorbed onto a plated surface. Nicotinic acid, urea, thiourea, nicotinamide, thioglycolic acid and sodium thiosulfate are used as the compound having a lone pair of electrons, and at least one compound of them is added. A total amount of addition of them is 0.001–1.0 gram/liter and more preferably 0.001–0.8 gram/liter. Nicotinic acid, urea, thiourea, nicotinamide, thioglycolic acid and sodium thiosulfate are convenient because they are easily dissolved into a chloride plating solution for zinc-nickel alloy plating, respectively. When an amount of addition is less than 0.001 gram/liter, an effect for restraining the growth of plated crystals is insufficient, whereas when it exceeds 1.0 gram/liter, a nickel content in a plated layer is greatly lowered, and thus such an amount of addition is not preferable.

The compound having a lone pair of electrons exhibits a greater effect when used together with a compound bearing a carbon-carbon double bond.

When emphasis is particularly placed on the restraint of needle-shaped stain among the advantages of the present invention, polyethylene glycol (PEG), having a molecular weight of 400–800, is suitable as a nonionic surfactant in the present invention and an amount of addition of polyethylene glycol is 0.1–1.0 gram/liter and more preferably 0.1–0.8 gram/liter. When a molecular weight of polyethylene glycol is less than 400, wettability is not sufficiently improved, whereas when a molecular weight exceeds 800, a nickel content in a plated layer is greatly lowered, and thus such a molecular weight is not preferable. When an amount of addition of the polyethylene glycol is less than 0.1 gram/liter, wettability is not sufficiently improved, whereas when it exceeds 1.0 gram/liter, a nickel content in a plated layer is greatly lowered, and thus such an amount of addition is not preferable.

Nicotinic acid, urea, thiourea, nicotinamide, thioglycolic acid and sodium thiosulfate are used as a compound having a lone pair of electrons in a plating solution, and at least one compound of them is added. A total amount of addition of them is 0.01–1.0 gram/liter and more preferably 0.01–0.8 gram/liter. Nicotinic acid, urea, thiourea, nicotinamide, thioglycolic acid and sodium thiosulfate are convenient because they are easily dissolved into a chloride plating solution for zinc-nickel alloy plating, respectively. When an amount of addition of them is less than 0.01 gram/liter, an effect for restraining the growth of plated crystals is insufficient, whereas when it exceeds 1.0 gram/liter, a nickel content in a plated layer is greatly lowered, and thus such an amount of addition of them is not preferable.

The compound having a lone pair of electrons exhibits a greater effect when used together with a compound bearing a carbon-carbon double bond in the same way. When emphasis is particularly placed on the restraint of the burning at the edge of a steel sheet among the advantages of the present invention, polyethylene glycol (PEG) having a molecular weight of 400–800 is contained in a plating solution in an amount of 0.01–0.20 gram/liter as a nonionic surfactant in the present invention. A suitable molecular weight of polyethylene glycol is 400–800. When a molecular weight is less than 400, burning is not sufficiently restrained, whereas when it exceeds 800, a nickel content in a plated layer is greatly lowered, and thus such a molecular weight is not preferable. A preferable amount of addition of the polyethylene glycol is 0.01–0.2 gram/liter and more preferably 0.01–0.1 gram/liter. When an amount of addition is less than 0.01 gram/liter, burning is not sufficiently improved, whereas when it exceeds 0.2 gram/liter, unevenness is liable to be caused to the outside appearance of an edge, and thus such an amount of addition is not preferable.

At the time, at least one compound selected from the group consisting of thiourea, thioglycolic acid and sodium thiosulfate are contained in an amount of 0.001–0.02 gram/liter and more preferably 0.001–0.015 gram/liter as the compound having a lone pair of electrons in the plating solution. When an amount of addition is less than 0.001 gram/liter, burning is not sufficiently restrained, whereas when it exceeds 0.02 gram/liter, the compound is adsorbed to a plated surface and deteriorates a phosphate treatment property, and thus such an amount of addition is not preferable.

In the present invention, any of the above plating solutions is preferably added with an organic compound bearing a carbon-carbon double bond, because a greater effect can be exhibited by it. The organic compound restrains the growth of plated crystals at the portions where the flow of the plating solution is disturbed because the carbon-carbon double bond in molecules are adsorbed onto a plated surface. Organic acid of aliphatic or aromatic or its salt such as fumaric acid, sodium fumarate, disodium fumarate, maleic acid, sodium maleate, disodium maleate, sodium allylsulfonate etc. is suitable as the organic compound bearing a carbon-carbon double bond, and at least one compound of them may be added. A total amount of addition of them is 0.01–1.0 gram/liter and more preferably 0.01–0.8 gram/liter. Fumaric acid, sodium fumarate, disodium fumarate, maleic acid, sodium maleate, disodium maleate and sodium allylsulfonate are convenient because they are easily dissolved into a chloride plating solution for zinc-nickel alloy plating, respectively. When an amount of addition of them is less than 0.01 gram/liter, an effect for restraining the growth of plated crystals is not sufficient, whereas when it exceeds 1.0 gram/liter, a nickel content in a plated layer is greatly lowered, and thus such an amount of addition of them is not preferable.

A cold-rolled steel sheet, hot-rolled steel sheet and the like as a material sheet are plated using the chloride zinc-nickel alloy plating solution of the present invention at a plating temperature of 40°–70° C. and a current density of 50–150 A/dm$^2$ after a pretreatment such as usual degreasing, acid pickling, rinsing with water and the like. However, the above pretreatment conditions and plating conditions are not particularly limited.

Next, the present invention will be specifically described with reference to examples.

EXAMPLES

Zinc-nickel alloy plated steel sheets were made using plating baths shown in Table 1 and Table 2 and a degree of occurrence of needle-shaped stain and a degree of occurrence of burning were evaluated. Table 1 and Table 2 show the results of evaluation.

Evaluation of Degree of Occurrence of Needle-Shaped Stain

A concave scratch having a radius of 1 mm and a depth of 1 mm were previously formed on steel sheets to disturb the flow of plating solutions. After zinc-nickel plating was effected to the steel sheets with an amount of plating of 30 grams/m$^2$ under the conditions of an average flow rate of the solutions of 1 m/sec, a plating temperature of 60° C. and a current density of 100 A/dm$^2$ (nickel content: 12–13 wt %), the lengths of white needle-shaped stain caused from the scratched portions were measured and the results of measurement were evaluated as follows.

| Length of Needle-shaped Stain | Evaluation | Symbol of Evaluation |
|---|---|---|
| less than 1 mm | not occurred | o |
| 1 mm or more to less than 2 mm | slightly occurred | Δ |
| 2 mm or more | greatly occurred | x |

Evaluation of Degree of Occurrence of Burning

Zinc-nickel alloy plating was effected using cold-rolled steel sheets of 100×100 mm under the conditions of an average flow rate of solutions of 1 m/sec, a plating temperature of 60° C. and a current density condition of 300 A/dm$^2$ by which current concentration can be reproduced at an edge. Then, a ratio of area of a black portion to an entire plated surface was measured.

Evaluation of Outside Appearance of Edge

Zinc-nickel alloy plating was effected using cold-rolled steel sheets of 100×200 mm under the conditions of an average flow rate of solutions of 1 m/sec, a plating temperature of 60° C. and a current density of 100 A/dm$^2$. The outside appearance of edges was evaluated based on the following criterion.

| Determination | Outside Appearance |
|---|---|
| o | without unevenness |
| Δ | with slight unevenness |
| x | with unevenness |

Evaluation of Phosphate Treatment Property

Zinc-nickel alloy plated steel sheets of 20 grams/m$^2$ were subjected to a dipping type phosphate treatment and the uniformity of the phosphate treated outside appearance was evaluated based on the following criterion.

| Determination | Outside Appearance |
|---|---|
| o | without unevenness/pattern |
| Δ | with slight unevenness/pattern |
| x | with unevenness/pattern |

As apparent from Table 1 and Table 2 showing a degree of occurrence of needle-shaped stain, a ratio of area a black portion and uneven outside appearance of the edge of each steel sheet, it is found that the plating solutions of the present invention are difficult to cause needle-shaped stain and burning.

As described above, when the plating solutions of the present inventions are used, since no needle-shaped stain is caused on a plated surface and an edge need not be trimmed because a less amount of burning is caused thereto, the present invention has a great industrial value.

TABLE 1

| | $ZnCl_2$ mol/L | $NiCl_2$ mol/L | KCl mol/L | Molar Ratio | Polyethylene Molecular Weight: Added Amount (g/L) | Compound Having a Lone Pair of Electrons (g/L) | Compound Bearing a Carbon-Carbon Double Bond (g/L) | wt % of Nickel in Plated Layer | Evaluation of Needle-Shaped Stain | Area Ratio of Black Portion | Unevenness of Edge Outside Appearance | Phosphate Treated Outside Appearance |
|---|---|---|---|---|---|---|---|---|---|---|---|---|
| Example 1 | 2.29 | 0.38 | 4.35 | 0.142 | PEG600: 0.50 | Urea 0.67 | Disodium fumarate 0.03 | 13.0 | o | 16.3 | Δ | Δ |
| Example 2 | 2.53 | 0.42 | 4.09 | 0.142 | PEG600: 0.40 | Urea 0.10 | Maleic acid 0.10 | 13.0 | o | 15.9 | Δ | Δ |
| Example 3 | 2.60 | 0.45 | 4.86 | 0.147 | PEG600: 0.60 | Urea 0.20 | Sodium allylsulfonate 0.20 | 13.4 | o | 17.2 | Δ | Δ |
| Example 4 | 0.90 | 0.15 | 3.02 | 0.142 | PEG450: 0.95 | Nicotinic acid 0.02 | Fumaric acid 0.10 | 13.0 | o | 14.3 | Δ | o |
| Example 5 | 3.30 | 0.62 | 4.97 | 0.158 | PEG950: 0.11 | Thioglycolic acid 0.02 | Sodium maleate 0.90 | 14.4 | o | 9.1 | o | o |
| Example 6 | 2.05 | 0.31 | 4.15 | 0.131 | PEG600: 0.45 | Sodium thiosulfate 0.95 | Sodium fumarate 0.02 | 11.9 | o | 8.1 | Δ | Δ |
| Example 7 | 3.00 | 0.57 | 4.75 | 0.159 | PEG600: 0.60 | Nicotinamide 0.05 | Disodium maleate 0.25 | 14.6 | o | 13.2 | Δ | Δ |
| Example 8 | 2.60 | 0.45 | 3.95 | 0.147 | PEG600: 0.12 | Thiourea 0.022 | | 13.3 | o | 10.7 | Δ | Δ |
| Example 9 | 1.50 | 0.23 | 3.45 | 0.133 | PEG800: 0.12 | Urea 0.10 | Fumaric acid 0.008 | 12.2 | o | 17.2 | o | Δ |
| Comp. Example 1 | 2.53 | 0.42 | 4.10 | 0.142 | — | — | — | 13.0 | x | 35.2 | x | o |
| Comp. Example 2 | 1.50 | 0.23 | 3.45 | 0.132 | PEG200: 0.80 | Nicotinamide 0.35 | Disodium fumarate 0.17 | 12.1 | x | 29.3 | x | o |
| Comp. Example 3 | 2.29 | 0.38 | 4.00 | 0.142 | PEG-1000: 0.75 | Urea 0.10 | Sodium allylsulfonate 0.91 | 7.6 | Δ | 10.9 | x | o |
| Comp. Example 4 | 2.60 | 0.45 | 3.95 | 0.147 | PEG600: 1.05 | Nicotinic acid 1.10 | Maleic acid 1.20 | 6.8 | Δ | 13.5 | x | o |

TABLE 2

| | $ZnCl_2$ mol/L | $NiCl_2$ mol/L | KCl mol/L | Molar Ratio | Polyethylene Molecular Weight: Added Amount (g/L) | Compound Having a Lone Pair of Electrons (g/L) | Compound Bearing a Carbon-Carbon Double Bond (g/L) | wt % of Nickel in Plated Layer | Evaluation of Needle-Shaped Stain | Area Ratio of Black Portion | Unevenness of Edge Outside Appearance | Phosphate Treated Outside Appearance |
|---|---|---|---|---|---|---|---|---|---|---|---|---|
| Example 10 | 2.30 | 0.40 | 4.40 | 0.148 | PEG600: 0.025 | Thiourea 0.005 | | 13.3 | Δ | 12.4 | o | o |
| Example 11 | 2.50 | 0.41 | 4.10 | 0.141 | PEG600: 0.050 | Thioglycolic acid 0.010 | | 13.0 | Δ | 11.3 | o | o |

TABLE 2-continued

| | $ZnCl_2$ mol/L | $NiCl_2$ mol/L | KCl mol/L | Molar Ratio | Polyethylene Molecular Weight: Added Amount (g/L) | Compound Having a Lone Pair of Electrons (g/L) | Compound Bearing a Carbon-Carbon Double Bond (g/L) | wt % of Nickel in Plated Layer | Evaluation of Needle-Shaped Stain | Area Ratio of Black Portion | Unevenness of Edge Outside Appearance | Phosphate Treated Outside Appearance |
|---|---|---|---|---|---|---|---|---|---|---|---|---|
| Example 12 | 2.62 | 0.45 | 4.90 | 0.147 | PEG600: 0.075 | Sodium thiosulfate 0.015 | | 13.4 | Δ | 10.8 | ○ | ○ |
| Example 13 | 0.91 | 0.16 | 3.12 | 0.150 | PEG450: 0.100 | Thiourea 0.020 | Sodium maleate 0.100 | 14.0 | ○ | 9.2 | ○ | ○ |
| Example 14 | 3.31 | 0.63 | 4.98 | 0.160 | PEG750: 0.010 | Thiourea 0.001 | Disodium fumarate 0.010 | 14.4 | Δ | 8.5 | ○ | ○ |
| Example 15 | 2.05 | 0.31 | 4.20 | 0.131 | PEG600: 0.040 | Thiourea 0.008 | Maleic acid 0.040 | 11.9 | Δ | 9.6 | ○ | ○ |
| Example 16 | 2.38 | 0.40 | 4.09 | 0.144 | PEG600: 0.050 | Thiourea 0.010 | Sodium allylsulfonate 0.050 | 12.6 | Δ | 9.8 | ○ | ○ |
| Comp. Example 5 | 2.53 | 0.42 | 4.10 | 0.142 | — | — | — | 13.0 | x | 35.2 | x | ○ |
| Comp. Example 6 | 1.50 | 0.23 | 3.46 | 0.132 | PEG300: 0.080 | Thiourea 0.005 | | 12.1 | x | 28.9 | Δ | ○ |
| Comp. Example 7 | 2.29 | 0.38 | 4.01 | 0.142 | PEG900: 0.075 | Thiourea 0.001 | | 7.6 | x | 11.8 | Δ | ○ |
| Comp. Example 8 | 2.00 | 0.34 | 3.90 | 0.145 | PEG600: 0.0005 | Thiourea 0.005 | | 13.2 | x | 33.8 | Δ | ○ |

What is claimed is:

1. An electrolytic zinc-nickel alloy plating solution, comprising:

a solution comprising:

zinc chloride, nickel chloride and potassium chloride;

polyethylene glycol having a molecular weight of 400–800 as a non-ionic surfactant in an amount of 0.01 to 1.0 gram/liter; and at least one compound selected from the group consisting of nicotinic acid, urea, thiourea, nicotinamide, thioglycolic acid and sodium thiosulfate as a compound having a lone pair of electrons in an amount of 0.001–1.0 gram/liter.

2. An electrolytic zinc-nickel alloy plating solution according to claim 1, wherein said polyethylene glycol having a molecular weight of 400–800 is used in an amount of 0.1–1.0 gram/liter as said non-ionic surfactant and said at least one compound selected from the group consisting of nicotinic acid, urea, thiourea, nicotinamide, thioglycolic acid and sodium thiosulfate is used in an amount of 0.01–1.0 gram/liter as said compound having a lone pair of electrons.

3. An electrolytic zinc-nickel alloy plating solution according to claim 2, further comprising at least one compound selected from the group consisting of fumaric acid, sodium fumarate, disodium fumarate, maleic acid, sodium maleate, disodium maleate and sodium allylsulfonate as a compound bearing a carbon-carbon double bond in an amount of 0.01–1.0 gram/liter.

4. An electrolytic zinc-nickel alloy plating solution according to claim 3, further comprising at least one compound selected from the group consisting of fumaric acid, sodium fumarate, disodium fumarate, maleic acid, sodium maleate, disodium maleate and sodium allylsulfonate as a compound bearing a carbon-carbon double bond in an amount of 0.01–1.0 gram/liter.

5. An electrolytic zinc-nickel alloy plating solution according to claim 1, wherein said polyethylene glycol having a molecular weight of 400–800 is used in an amount of 0.01–0.2 gram/liter as said nonionic surfactant and said at least one compound selected from the group consisting of thiourea, thioglycolic acid and sodium thiosulfate is used in an amount of 0.001–0.2 gram/liter as said compound having a lone pair of electrons.

6. An electrolytic zinc-nickel alloy plating solution according to claim 1, further comprising at least one compound selected from the group consisting of fumaric acid, sodium fumarate, disodium fumarate, maleic acid, sodium maleate, disodium maleate and sodium allylsulfonate as a compound bearing a carbon-carbon double bond in an amount of 0.01–1.0 gram/liter.

7. A method of manufacturing a zinc-nickel alloy plated steel sheet, comprising the step of plating a steel sheet with an electrolytic zinc-nickel alloy using a plating solution according to claim 1, at a plating temperature of 40°–70° C. and a current density of 50–150 A/dm$^2$.

8. An electrolytic zinc-nickel alloy plating solution, comprising:

a solution consisting essentially of:

zinc chloride, nickel chloride and potassium chloride;

polyethylene glycol having a molecular weight of 400–800 as a non-ionic surfactant in an amount of 0.01 to 1.0 gram/liter; and at least one compound selected from the group consisting of nicotinic acid, urea, thiourea, nicotinamide, thioglycolic acid and sodium thiosulfate as a compound having a lone pair of electrons in an amount of 0.001–1.0 gram/liter.

9. A method of manufacturing a zinc-nickel alloy plated steel sheet, comprising the steps of:

preparing an electrolytic zinc-nickel alloy plating solution, wherein the zinc-nickel alloy plating solution comprises:

a solution comprising:

zinc chloride, nickel chloride and potassium chloride, polyethylene glycol having a molecular weight of 400–800 as a nonionic surfactant in an amount of 0.01 to 1.0 gram/liter, and at least one compound selected from the group consisting of nicotinic acid, urea, thiourea, nicotinamide, thioglycolic acid and sodium thiosulfate as a compound having a lone pair of electrons in an amount of 0.001–1.0 gram/liter; and plating a steel sheet with said electrolytic zinc-nickel alloy plating solution at a plating temperature of 40°–70° C. and a current density of 50–150 A/dm$^2$.

10. A method of manufacturing a zinc-nickel alloy plated steel sheet according to claim 9, wherein said polyethylene glycol having a molecular weight of 400–800 is used in an amount of 0.1–1.0 gram/liter as said nonionic surfactant and said at least one compound selected from the group consisting of nicotinic acid, urea, thiourea, nicotinamide, thioglycolic acid and sodium thiosulfate is used in an amount of 0.01–1.0 gram/liter as said compound having a lone pair of electrons.

11. A method of manufacturing a zinc-nickel alloy plated steel sheet according to claim 10, wherein the zinc-nickel alloy plating solution further comprises at least one compound selected from the group consisting of fumaric acid, sodium fumarate, disodium fumarate, maleic acid, sodium maleate, disodium maleate and sodium allylsulfonate as a compound bearing a carbon-carbon double bond in an amount of 0.01–1.0 gram/liter.

12. A method of manufacturing a zinc-nickel alloy plated steel sheet according to claim 9, wherein said polyethylene glycol having a molecular weight of 400–800 is used in an amount of 0.01–0.2 gram/liter as said nonionic surfactant and said at least one compound selected from the group consisting of thiourea, thioglycolic acid and sodium thiosulfate is used in an amount of 0.001–0.02 gram/liter as said compound having a lone pair of electrons.

13. A method of manufacturing a zinc-nickel alloy plated steel sheet according to claim 12, wherein said zinc-nickel alloy plating solution further comprises at least one compound selected from the group consisting of fumaric acid, sodium fumarate, disodium fumarate, maleic acid, sodium maleate, disodium maleate and sodium allylsulfonate as a compound bearing a carbon-carbon double bond in an amount of 0.01–1.0 gram/liter.

14. A method of manufacturing a zinc-nickel alloy plated steel sheet according to claim 9, wherein the zinc-nickel alloy plating solution further comprises at least one compound selected from the group consisting of fumaric acid, sodium fumarate, disodium fumarate, maleic acid, sodium maleate, disodium maleate and sodium allylsulfonate as a compound bearing a carbon-carbon double bond in an amount of 0.01–1.0 gram/liter.

* * * * *